US008493417B2

(12) United States Patent
Cho

(10) Patent No.: US 8,493,417 B2
(45) Date of Patent: Jul. 23, 2013

(54) FIELD SEQUENTIAL IMAGE DISPLAY APPARATUS AND METHOD OF DRIVING THE SAME

(75) Inventor: Hyun-seung Cho, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 972 days.

(21) Appl. No.: 11/700,817

(22) Filed: Feb. 1, 2007

(65) Prior Publication Data

US 2007/0176943 A1 Aug. 2, 2007

Related U.S. Application Data

(60) Provisional application No. 60/764,355, filed on Feb. 2, 2006.

(30) Foreign Application Priority Data

Apr. 28, 2006 (KR) ..... 10-2006-0038860

(51) Int. Cl.
*G09G 5/10* (2006.01)
*G09G 3/36* (2006.01)

(52) U.S. Cl.
USPC ..... 345/690; 345/102; 345/89

(58) Field of Classification Search
USPC ..... 345/690, 87–89, 102
See application file for complete search history.

(56) References Cited

U.S. PATENT DOCUMENTS 6,115,016 A * 9/2000 Yoshihara et al. ..... 345/88
2002/0122019 A1* 9/2002 Baba et al. ..... 345/88
2002/0196220 A1* 12/2002 Sato et al. ..... 345/87
2005/0116922 A1 6/2005 Kim
2005/0225575 A1* 10/2005 Brown Elliott et al. ..... 345/694
2006/0152534 A1* 7/2006 Chang et al. ..... 345/690

FOREIGN PATENT DOCUMENTS

| | | | |
|---|---|---|---|
| JP | 2002221702 | A | 8/2002 |
| JP | 2002351423 | A | 12/2002 |
| JP | 2003241714 | A | 8/2003 |
| JP | 2003280614 | A | 10/2003 |
| JP | 2004333576 | A | 11/2004 |
| JP | 2005-148173 | A | 6/2005 |
| JP | 2005157394 | A | 6/2005 |
| JP | 2005181559 | A | 7/2005 |
| JP | 2005233982 | A | 9/2005 |
| KR | 20020080248 | A | 10/2002 |

OTHER PUBLICATIONS

Machine Translation of JP2005-148173.*
Communication, dated Oct. 11, 2011, issued by the European Patent Office in corresponding European Application No. 07101429.4.
Communication dated May 7, 2012 issued by the Korean Intellectual Property Office in counterpart Korean Application No. 10-2006-0038860.
Communication dated Mar. 13, 2012 issued by the Japanese Patent Office in counterpart Japanese Application No. 2007-023460.

* cited by examiner

*Primary Examiner* — Amr Awad
*Assistant Examiner* — Randal Willis
(74) *Attorney, Agent, or Firm* — Sughrue Mion, PLLC

(57) ABSTRACT

Provided are a field sequential image display apparatus that reduces flicker and a method of driving the same. The field sequential image display apparatus, which uses a plurality of single color light sources, includes: an image analyzing unit dividing frames of an image signal into fields, whereby the number of fields is greater than the number of single color light sources; an image display panel displaying the fields sequentially; and a light source unit comprising the plurality of single color light sources that are independently driven or driven with other light sources in order to supply lights corresponding to the color components of the fields to the image display panel, wherein an average driving frequency of the single color light sources is higher than a frame rate.

32 Claims, 10 Drawing Sheets

FIELD SEQUENTIAL IMAGE DISPLAY APPARATUS AND METHOD OF DRIVING THE SAME

CROSS-REFERENCE TO RELATED PATENT APPLICATIONS

This application claims the benefit of Korean Patent Application No. 10-2006-0038860, filed on Apr. 28, 2006, in the Korean Intellectual Property Office and U.S. Provisional Patent Application No. 60/764,355, filed on Feb. 2, 2006, in the U.S. Patent and Trademark Office, the disclosures of which are incorporated herein in their entirety by reference.

BACKGROUND OF THE INVENTION

1. Field of the Invention

The present invention relates to an image display and a method of driving the same, and more particularly, to a field sequential image display apparatus that reduces flicker and a method of driving the same.

2. Description of the Related Art

Examples of image displays that have an additional light source are flat panel displays such as liquid crystal displays (LCDs) and projection type displays such as liquid crystal on silicon (LCoS) devices and digital micro-mirror devices (DMD). These image displays can be widely used as monitors of computers and televisions.

LCDs, for example, display images by adjusting light transmittance of pixels after supplying voltages to each of the pixels on a liquid crystal panel according to input image signals. LCDs can be classified as red (R), green (G), and blue (B) color filter type LCDs, and field sequential driving type LCDs according to types of color images displayed.

In color filter LCDs, a unit pixel is divided into R, G, and B sub-pixels, and R, G, and B color filters are disposed on the R, G, and B sub-pixels respectively. Thus, light is transmitted to the R, G, and B color filters from one backlight unit to display color images. In color filter LCDs, the operation of the backlight unit is not linked with frame rate, and the backlight may be driven at a frequency so high that humans cannot detect. For example, in a conventional color filter LCD, the backlight can be driven at 150 Hz even when the frame rate is 60 Hz.

Meanwhile, in a field sequential LCD, R, G, and B lights transferred from R, G, and B backlights are displayed time-divisionally on the liquid crystal panel, thereby displaying color images using an after image effect. In order to sequentially display the image in a time-division manner, a field sequential LCD divides one frame of an image into R, G, and B fields and displays the R, G, and B fields on a screen sequentially. In a field sequential LCD, a resolution three times higher than that of a color filter LCD in a panel of the same size can be obtained, and moreover, the field sequential LCD has many advantages such as a large color gamut, absence of motion blur, low power consumption, and low fabrication costs due to the absence of the color filter processes.

In a field sequential LCD which typically has a frame rate of 60 Hz, when a frame is divided into three fields (R, G, and B fields), time allocated to a frame is 16.7 ms (1/60 s), and time allocated to a field is 5.56 ms (1/180 s). Changes of fields with the time interval of 5.56 ms, cannot be detected by human beings, and thus, the user recognizes three fields as a combined image in 16.7 ms and a color image by combining the R, G, and B colors is obtained.

However, since a conventional field sequential LCD supplies R, G, and B lights corresponding to the R, G, and B fields in the time-division manner, each of the R, G, and B backlights operates once in a frame. That is, the R, G, and B backlights emit light at the same frequency as the frame rate. For example, the R, G, and B backlights in a field sequential LCD having a frame rate of 60 Hz are driven at the frequency of 60 Hz.

FIG. 1A is a graph showing peaks of light intensity according to frequency in a color filter LCD including a backlight driven at a frequency of 150 Hz, and FIG. 1B is a graph showing peaks of light intensity according to frequency in a field sequential LCD including backlights driven at a frequency of 60 Hz. In FIGS. 1A and 1B, horizontal axes denote frequency coordinates, vertical axes denote light intensities, a solid line parallel to the x axes denotes −40 dB, and dotted lines parallel to the y axes denote 70 Hz or 100 Hz.

Referring to FIG. 1A, light intensity peaks over −40 dB are generated periodically at every 150 Hz which is the driving frequency of the backlight. Referring to FIG. 1B, light intensity peaks over −40 dB are generated periodically at every 60 Hz which is the frame rate. The periods in which the light intensity peaks are generated closely relates to the generation of flicker or color breakup by the backlight. If the light flickers at a high frequency, human beings cannot detect the flicker of the lights due to the afterimage effect. In general, in a case where the light intensity peaks are generated at every 70 Hz or higher, flicker cannot be detected, however, the light intensity peaks generated at a frequency of less than every 70 Hz, flicker can be detected by human beings. Referring to FIGS. 1A and 1B, there is no repeated light intensity peak within a range of ±70 Hz frequency or a range of ±100 Hz frequency in the color filter LCD, however, there are repeated light intensity peaks within a range of ±70 Hz frequency or a range of ±100 Hz frequency in the field sequential LCD. In general, broadcast images have a frame rate of 60 Hz, and thus, the flicker phenomenon is present in a field sequential LCD due to the flickering of the backlight.

Because the driving frequencies of the R, G, and B light sources are low in a conventional field sequential LCD, flicker is generated. Therefore, in a conventional field sequential image display using single color light sources such as R, G, and B light sources, the driving frequency of the light sources is the same as the frame rate, and thus, flicker is commonly generated due to the single color light sources. Meanwhile, a conversion of the frame rate in order to increase the driving frequency of the single color light sources requires additional circuitry, and thus, fabrication costs increase.

SUMMARY OF EXEMPLARY EMBODIMENTS OF THE INVENTION

Exemplary embodiments of the present invention provide a field sequential image display apparatus that reduces flicker by increasing an average driving frequency of a single color light source without changing a frame rate, and a method of driving the same.

According to an aspect of the present invention, there is provided a field sequential image display apparatus, which uses a plurality of single color light sources, the apparatus including: an image analyzing unit dividing frames of an image signal into fields, whereby the number of fields is greater than the number of single color light sources; an image display panel displaying the fields sequentially; and a light source unit comprising the plurality of single color light sources that are independently driven or driven with other light sources in order to supply lights corresponding to the color components of the fields to the image display panel, wherein an average driving frequency of the single color light sources is higher than a frame rate.

According to another aspect of the present invention, there is provided a method of driving a field sequential image display apparatus using a plurality of single color light sources, the method including: dividing frames of an image signal into fields, whereby the number of fields is greater than the number of single color light sources; sequentially displaying the fields on an image display panel; and driving one or more of the single color light sources in synchronization with one of the displayed fields in order to supply light corresponding to a color component of the displayed field to the image display panel, wherein an average driving frequency of the single color light sources is greater than a frame rate.

BRIEF DESCRIPTION OF THE DRAWINGS

The above and other features of the present invention will become more apparent by describing in detail exemplary embodiments thereof with reference to the attached drawings in which.

DETAILED DESCRIPTION OF EXEMPLARY EMBODIMENTS OF THE INVENTION

Figure 1A:
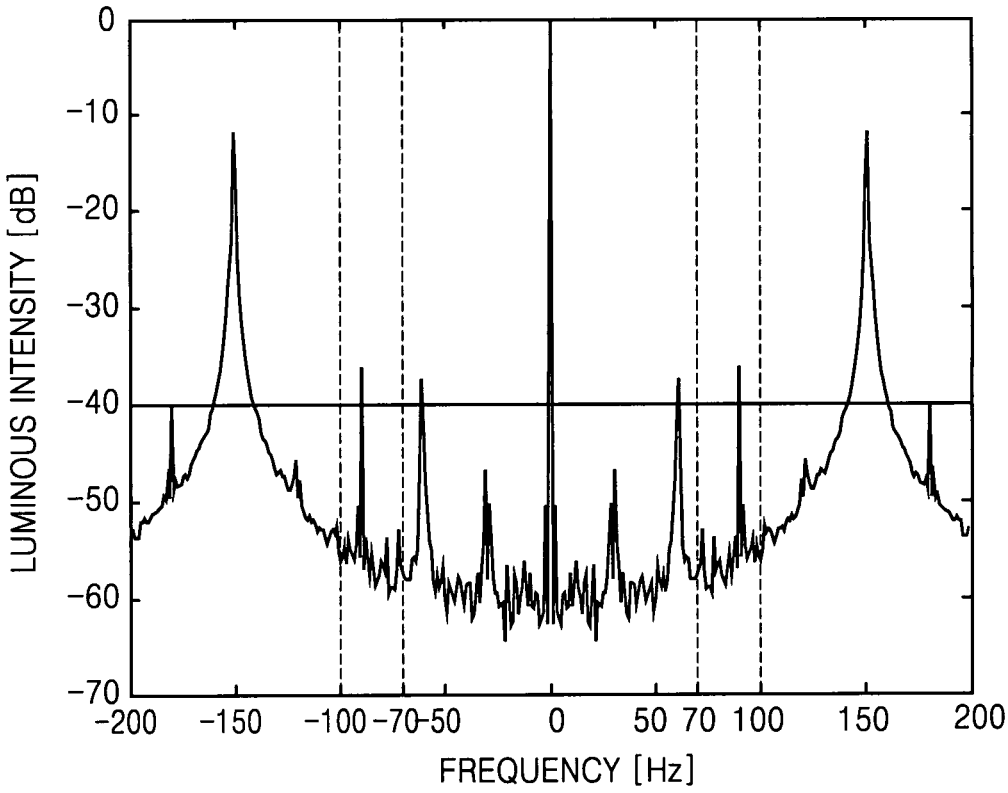
FIGS. 1A and 1B are graphs showing light intensity peaks according to frequency in conventional LCDs.
Figure 1B:
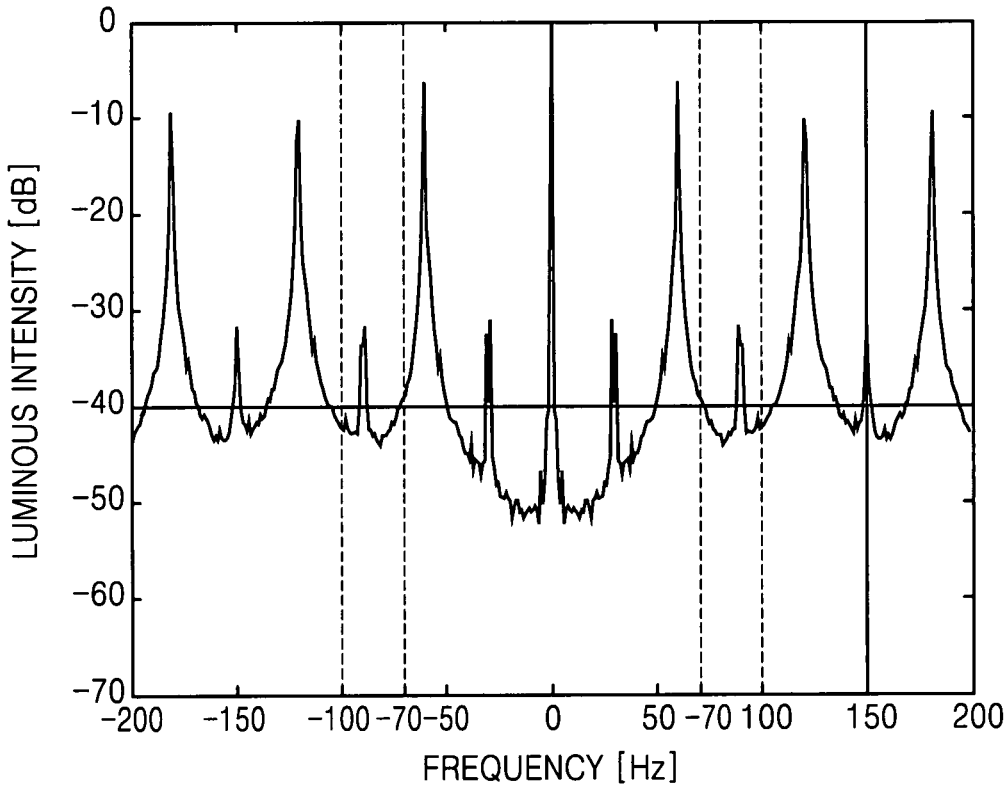
Figure 2:
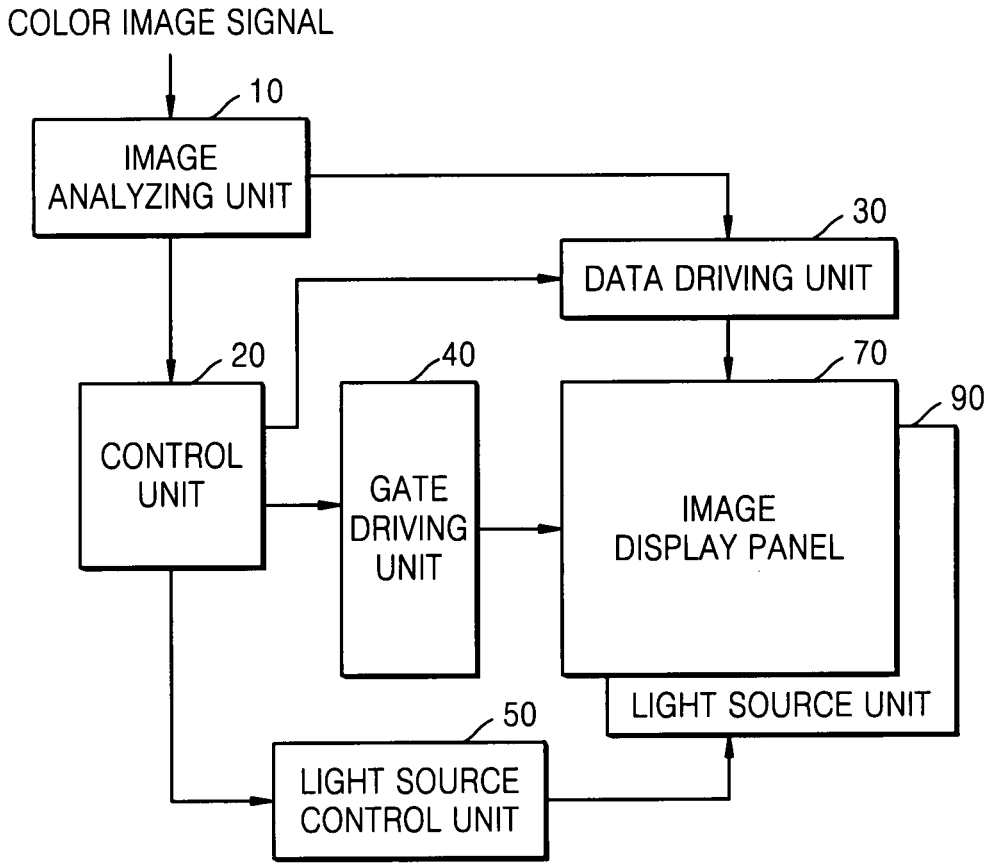
FIG. 2 is a schematic block diagram of a field sequential image display apparatus according to an exemplary embodiment of the present invention.

FIG. 2 is a schematic block diagram of a field sequential image display apparatus according to an exemplary embodiment of the present invention. In the current embodiment, a liquid crystal display (LCD) is used as an example of the field sequential image display apparatus.

Referring to FIG. 2, the field sequential image display apparatus includes an image analyzing unit 10, a control unit 20, an image display panel 70 displaying an image, and a light source unit 90 supplying light to the image display panel 70. The field sequential image display apparatus further includes a data driving unit 30 and a gate driving unit 40 driving the image display panel 70, and a light source driving unit 50 driving the light source unit 90.

The field sequential image display apparatus according to the current exemplary embodiment of the present invention can include separate single color light sources corresponding to the primary colors. In general, the single color light sources of the field sequential image display apparatus are red (R), green (G), and blue (B). If necessary, more single color light sources can be used in order to expand the color gamut. According to the current exemplary embodiment of the present invention, the three primary colors R, G, and B are used as single color light sources, however, the present invention is not limited thereto and more single color light sources can be used. Thus, RGB generally refers to the primary colors used in the image display apparatus according to the current exemplary embodiment of the present invention hereinafter.

The image analyzing unit 10 divides one frame of an image signal into fields, the number of which is greater than the number of single color light sources. Since the field sequential image display apparatus of the current embodiment uses R, G, and B light sources, the number of single color light sources is 3, and thus, a frame is divided into at least four fields. Each of the divided fields is an R, G, or B image, or a combination of the single color images. The image analyzing unit 10 converts each of the frames of the image signal into R, G, and B signals through a color space conversion, and each of the R, G, and B signals can form an R, G, or B field independently. Otherwise, each of the R, G, and B signals can form a Cy (cyan), M (magenta), Y (yellow), or W (white) field in combination with other fields. The single color field or the mixed color field is displayed sequentially on the image display panel 70 in a predetermined order. The displaying order of the fields will be described later.

The control unit 20 controls the data driving unit 30, the gate driving unit 40, and the light source driving unit 50 in connection with the image signal of the image analyzing unit 10.

A liquid crystal panel is used as the image display panel 70. In more detail, an optically compensated bend (OCB) mode liquid crystal panel is mainly used. The OCB mode liquid crystal panel is formed by disposing constantly aligned liquid crystal molecules between two polarizing plates crossing each other. The liquid crystal molecules are aligned in a symmetric bent state, that is, are disposed at an angle of 90° at a center between the alignment layers and then at a smaller angle toward the alignment layers. In an OCB mode liquid crystal panel, the liquid crystal molecules move rapidly in their alignment directions when a voltage is applied, and thus, the time for re-aligning the liquid crystal molecules, that is, a response time, is very short, that is, about a few ms.

The image signal that is divided into at least four fields is sequentially scanned onto every frame in the image display panel 70. The image display panel 70 includes m×n liquid crystal pixels arranged as a matrix, m data lines and n gate lines crossing each other, and thin film transistors (TFTs) formed where the data lines and the gate lines cross each other. The TFT formed on each of the liquid crystal pixels responds to a scan signal supplied to the gate driving unit 40, and performs a switching operation according to a data signal supplied from the data driving unit 30. The data driving unit 30 supplies image signals to the data lines in response to the control signal of the control unit 20. The gate driving unit 40 supplies scan pulses sequentially to the gate lines in response to the control signal of the control unit 20 to choose a horizontal line on the image display panel 70 to which the data signal is supplied.

The light source unit 90 includes three single color light sources, that is, R, G, and B light sources. The single color light sources sequentially emit lights corresponding to the color component of the fields independently or in combination with other light sources. A light emitting diode (LED), a cool cathode fluorescent lamp (CCFL), an external electrode fluorescent lamp (EEFL), or a hot cathode fluorescent lamp (HCFL) can be used as a light source. The light sources are disposed on a rear surface of the image display panel 70 to directly emit the lights onto the image display panel 70, or on side portions of the image display panel 70 to transmit the lights to the image display panel 70 through a light guide plate.

The light source unit 90 can be driven using a scrolling method. In the scrolling method, a screen is divided into regions, and the light source unit 90 lights onto each region. The screen is divided into regions corresponding to one or more gate lines. The light source unit 90 is driven independently by the region unit. When the scrolling method is used to drive the light source unit 90, lighting time of the light source can be increased and a contrast can be improved in a case where the liquid crystal panel is used as the image display panel 70.

Since at least four fields correspond to one frame of the image signal, an average driving frequency of each of the single color light sources that are driven corresponding to the fields is higher than the driving frequency of the frame. In general, a frame rate of the image signal is 60 Hz, and then, the average driving frequency of each of the light sources may be higher than 60 Hz, for example, 80 Hz. Since the light sources are driven in a predetermined period, flicker may be detected. For example, it is known that the flicker of the light sources driven at a frequency of 60 Hz can be detected. According to an exemplary embodiment of the present invention, when the frame rate is 60 Hz, the average driving frequency of the single color light sources is higher than 60 Hz, for example, 80 Hz without changing the frame rate, and thus, flicker cannot be detected.

A method of driving the field sequential image display apparatus according to an exemplary embodiment of the present invention will be described with reference to FIGS. 3 through 9.

Figure 3:
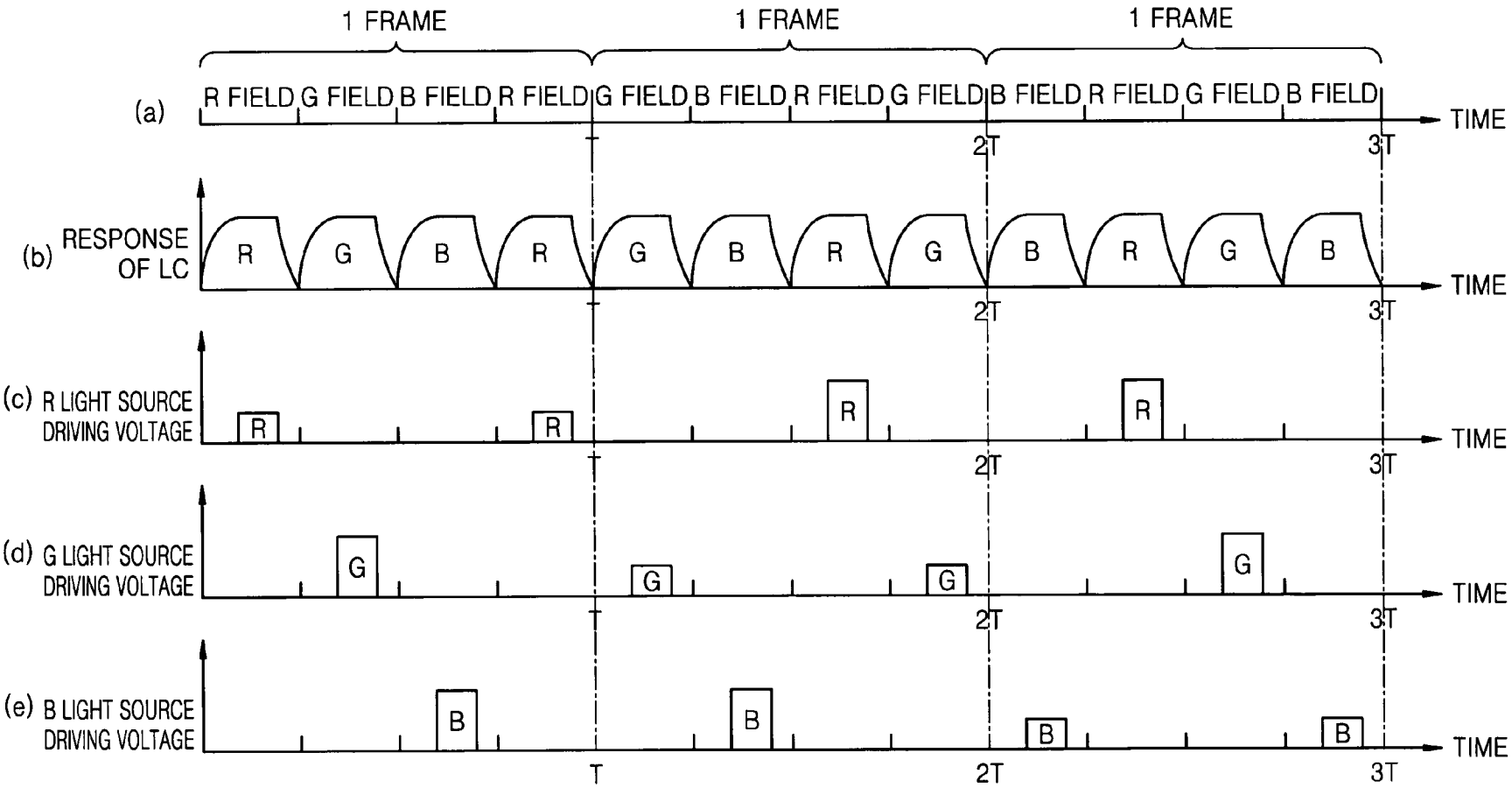
FIGS. 3 through 9 are views illustrating methods of driving the field sequential image display apparatus according to an exemplary embodiment of the present invention.

FIG. 3 is a view illustrating a method of driving the field sequential image display apparatus according to an exemplary embodiment of the present invention. According to the current exemplary embodiment, one frame of an image signal is divided into four fields, and the four fields include R, G, and B fields.

Referring to FIG. 3, the image analyzing unit 10 divides three subsequent frames of the image signal into R, G, B, and R fields, G, B, R, and G fields, and B, R, G, and B fields, respectively. The fields are displayed on the image display panel 70 such that two fields of the same color are not displayed successively. According to the current exemplary embodiment of the present invention, the fields are displayed in an order R, G, B, and R fields from 0 T to 1 T in a first frame, the fields are displayed in an order G, B, R, and G fields from 1 T to 2 T in a second frame, and the fields are displayed in an order B, R, G, and B fields from 2 T to 3 T in a third frame as shown in row (a) of FIG. 3. The image is realized by repeatedly displaying the above three frames. The R, G, and B fields are repeatedly circulated in view of the arrangement order of the fields, however, it is different from a conventional driving method in that four fields form one frame. Therefore, the same arrangement of the fields occurs in every three frames. When displaying the three frames, each of the R, G, and B fields is displayed four times repeatedly.

In the current exemplary embodiment of the present invention, the liquid crystal panel is used as the image display panel. Row (b) of FIG. 3 represents the response of liquid crystal according to time when the R, G, and B fields are displayed on the liquid crystal panel, and rows (c)-(e) represent driving voltages for driving the R, G, and B light sources. A predetermined time is required to align the liquid crystal after the image signal is applied, and thus, the R, G, and B light sources may be driven after the liquid crystal are aligned. According to the current exemplary embodiment of the present invention, after a field is scanned, the corresponding light source emits the light onto the entire liquid crystal panel.

Although a primary color field is shown twice in a frame, fields of the same color are not arranged successively, and thus, the light source corresponding to fields of the same color does not emit light twice consecutively. In an image signal typically having a frame rate of 60 Hz, 16.7 ms is applied to each frame, and 4.17 ms is applied to each field. Since each of the R, G, and B light sources is driven four times in every three successive frames, each of the R, G, and B light sources emits light with a period of 12.5 ms on average. The time interval can correspond to a driving frequency of 80 Hz.

As described above, when a frame is displayed on the image display panel, one of the R, G, and B fields is displayed once more to increase the average driving frequency of the R, G, and B light sources, and thus, flicker can be reduced. The above method does not convert the frame rate, and thus, signal processing can be performed simply.

Meanwhile, referring to FIG. 3, the R light source is driven twice while the G and B light sources are driven once in the first frame. When the R, G, and B light sources are driven differently from each other in the same frame, variation may occur between the brightness of the R, G, and B images. In order to remove the brightness difference, the driving voltage or irradiating time of each R, G, or B light source may be controlled in one frame so that the R, G, and B light sources can emit lights of constant brightness in the same frame. In row (c) and row (d) of FIG. 3, the driving voltages of the R, G, and B light sources are controlled so that the R, G, and B lights can have the constant brightness.

Figure 4:
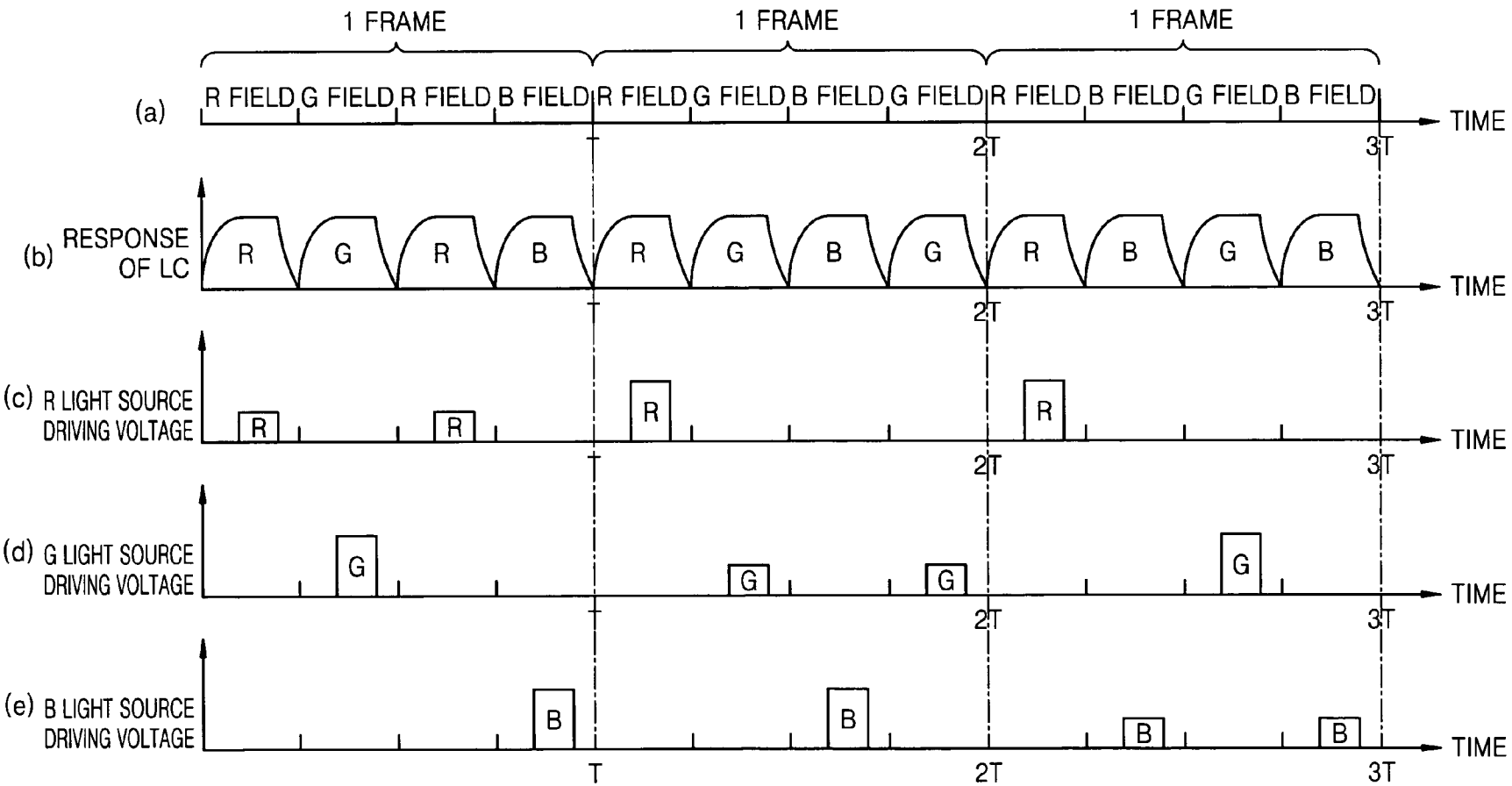

FIG. 4 is a view for illustrating a method of driving the field sequential image display apparatus according to another exemplary embodiment of the present invention. The current exemplary embodiment is substantially the same as the previous embodiment shown in FIG. 3 except for the arrangement order of the fields, and thus, differences of the current exemplary embodiment from the previous embodiment will be described.

Referring to FIG. 4, the image analyzing unit 10 divides three subsequent frames of an image signal into R, G, B, and R fields, R, G, B, and G fields, and R, B, G, and B fields, respectively. The fields are displayed in an order R, G, R, and B fields from 0 T to 1 T in a first frame, in an order R, G, B, and G fields from 1 T to 2 T in a second frame, and in an order R, B, G, and B fields from 2 T to 3 T in a third frame as shown in row (a) of FIG. 4. When displaying the three frames, each of the R, G, and B fields is displayed four times repeatedly. In addition, the same arrangement of the fields occurs in every three frames.

Row (b) in FIG. 4 represents the response of liquid crystal according to time when the R, G, and B fields are displayed on the liquid crystal panel, and rows (c)-(e) represent driving voltages for driving the R, G, and B light sources. Although a primary color field is shown twice in a frame, fields of the same color are not arranged successively, and thus, a light source corresponding to fields of the same color does not emit light twice consecutively. In an image signal typically having a frame rate of 60 Hz, since each of the R, G, and B light sources is driven four times in every three successive frames, each of the R, G, and B light sources emits light with a period of 12.5 ms on average. The time interval can correspond to a driving frequency of 80 Hz. When the R, G, and B light sources are driven with such a high driving frequency, flicker can be greatly reduced.

Figure 5:
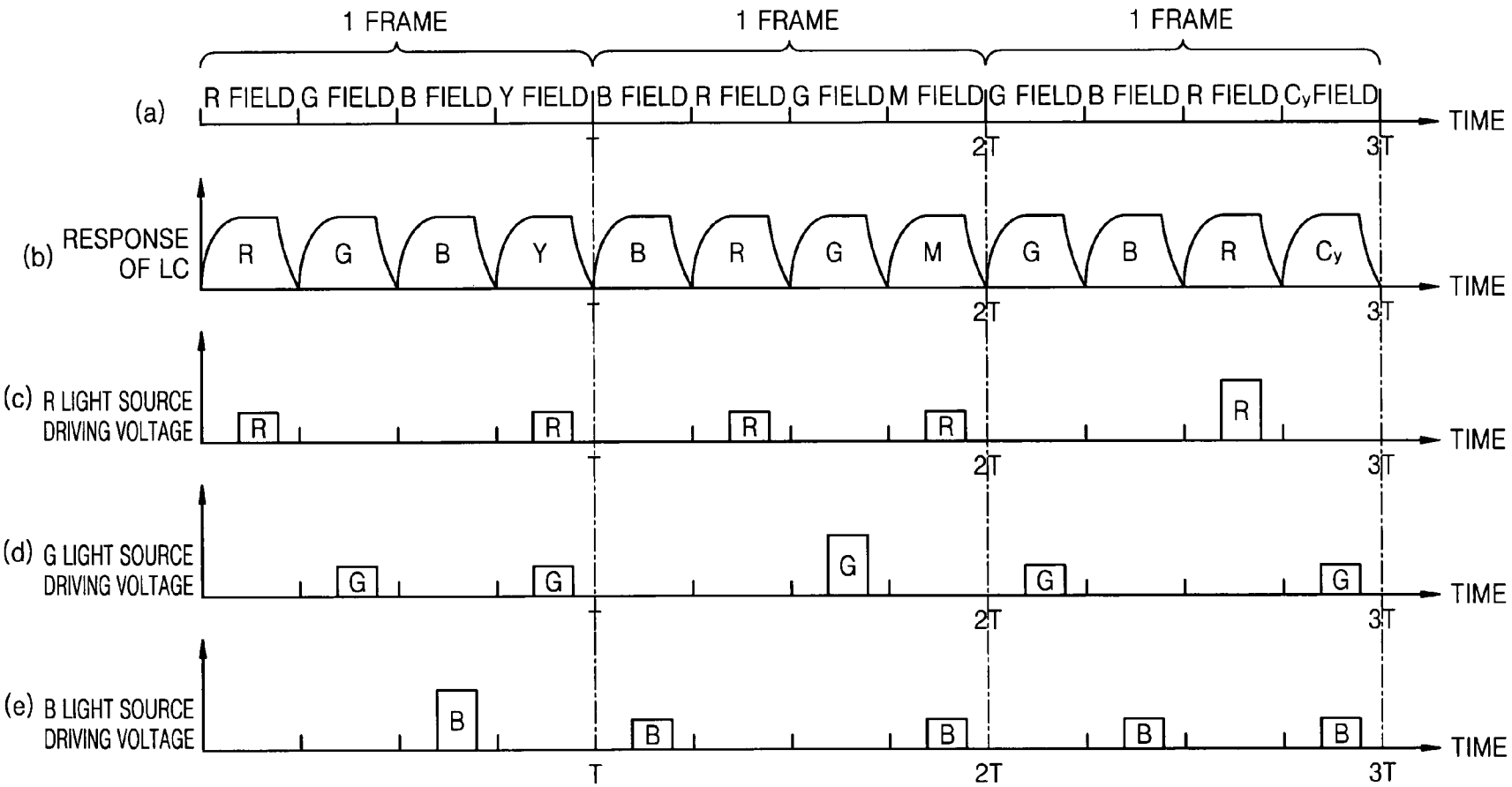

FIG. 5 is a view for illustrating a method of driving the field sequential image display apparatus according to another exemplary embodiment of the present invention.

Referring to FIG. 5, each of three frames of an image signal includes a Y, M, or Cy field in addition to the R, G, and B fields. That is, the image analyzing unit 10 divides the three frames of the image signal into R, G, B, and Y fields, B, R, G, and M fields, and G, B, R, and Cy fields, respectively. The Y, M, and Cy fields are obtained by mixing the R, G, and B fields, that is, the Y field is an image in which R and G images are overlapped, the M field is an image in which B and R images are overlapped, and the Cy field is an image in which G and B images are overlapped. The fields are arranged so that fields of the same color are not successively displayed on the image display panel. For example, as shown in FIG. 5, row (a), a first frame is displayed from 0 T to 1 T in an order of R, G, B, and Y fields, a second frame is displayed from 1 T to 2 T in an order of B, R, G, and M fields, and a third frame is displayed from 2 T to 3 T in an order of G, B, R, and Cy fields. The image is realized by repeatedly displaying the above three frames. When displaying the three frames, each of the R, G, and B fields is displayed three times, and each of the Y, M, and Cy fields is displayed once.

The light source unit 90 includes the R, G, and B light sources which correspond to the primary colors. The Y, M, and Cy lights corresponding to the Y, M, and Cy fields are obtained by mixing the lights. That is, R and G light sources are driven to correspond to the Y field, B and R light sources are driven to correspond to the M field, and the G and B light sources are driven to correspond to the Cy field.

Row (b) of FIG. 5 represents the response of the liquid crystal according to time in the liquid crystal panel, and rows (c)-(e) represent driving voltages for driving the R, G, and B light sources. In the current exemplary embodiment of the present invention, each of the R, G, and B light sources is driven twice in one frame, but is not driven consecutively. In an image signal having a frame rate of 60 Hz, each of the R, G, and B light sources is driven five times in every three frames, and thus, is driven with a period of 10 ms on average. The time interval can be converted into a driving frequency of 100 Hz. Since the R, G, and B light sources are driven with such a high driving frequency, flicker can be greatly reduced.

Figure 6:
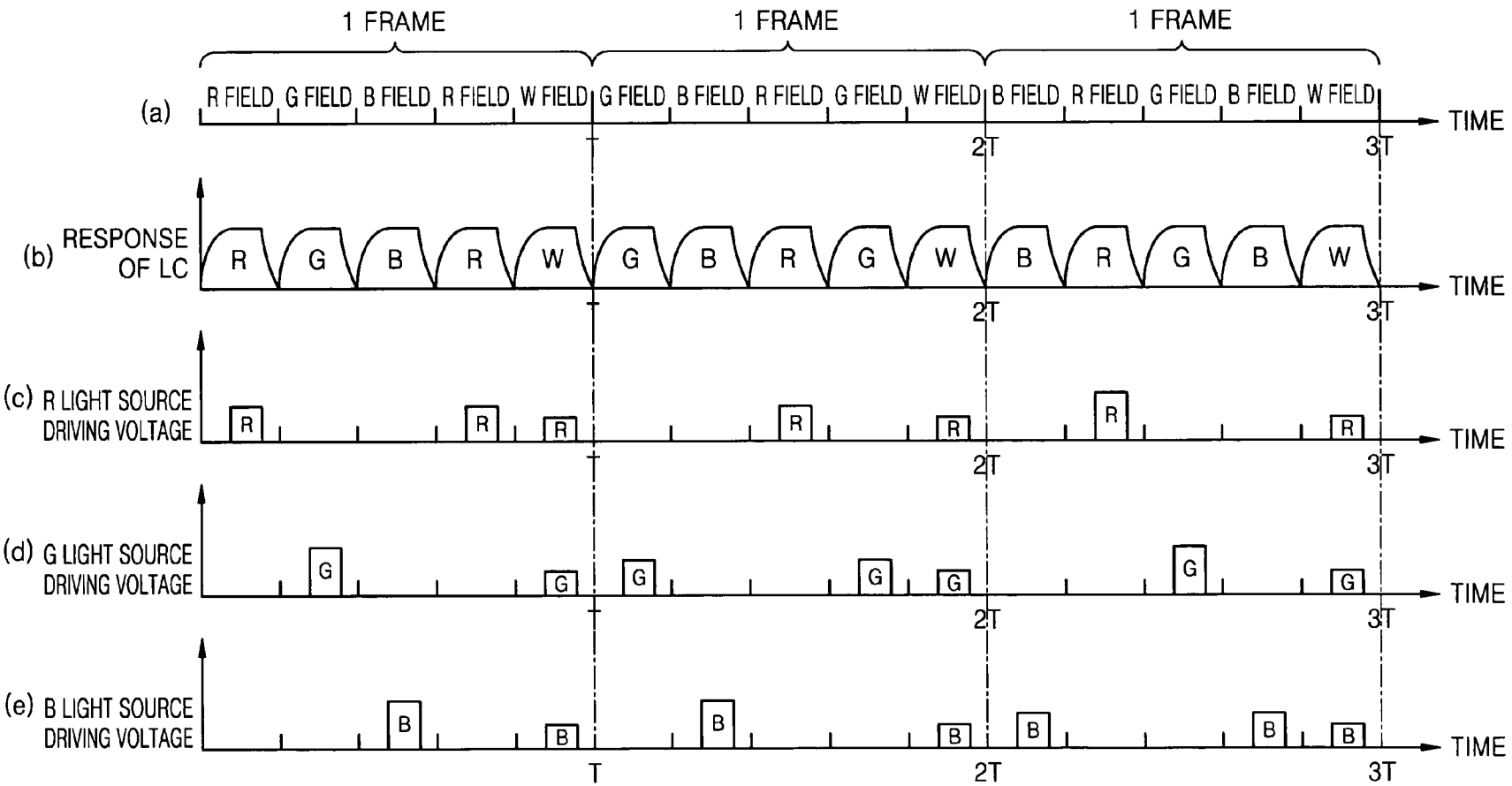

FIG. 6 is a view illustrating a method of driving the field sequential image display apparatus according to another exemplary embodiment of the present invention. According to the current exemplary embodiment of the present invention, one frame is divided into five fields, and one of the five fields is a white (W) field. The W field displays a W image.

Referring to FIG. 6, each of the frames includes primary fields corresponding to the R, G, and B primary colors and the W field, and further includes one of the R, G, and B fields. That is, the image analyzing unit 10 divides three frames of an image signal into R, G, B, R, and W fields, R, G, B, G, and W fields, and R, G, B, B, and W fields, respectively. In the current embodiment of the present invention, as shown in row (a) of FIG. 6, a first frame is displayed from 0 T to 1 T in an order of R, G, B, R and W fields, a second frame is displayed from 1 T to 2 T in an order of G, B, R, G, and W fields, and a third frame is displayed from 2 T to 3 T in an order of B, R, G, B, and W fields. The fields are displayed in such an order as not to display fields of the same color successively on the image display panel. The same arrangement of the fields occurs in every three frames. When displaying the three frames, each of the R, G, and B fields is repeatedly displayed four times, and the W field is displayed three times.

Row (b) of FIG. 6 represents the response of the liquid crystal molecules according to time in the liquid crystal panel, and rows (c)-(e) represent driving voltages for driving the R, G, and B light sources. In the W field, the R, G, and B light sources are simultaneously driven to emit W light. In an image signal having a frame rate of 60 Hz, each of the R, G, and B light sources is driven seven times in every three frames, and thus, each of the R, G, and B-light sources is driven with a period of 7.14 ms on average. The time interval can be converted into a driving frequency of 140 Hz. Since the R, G, and B light sources are driven with such a high driving frequency, flicker can be greatly reduced.

According to the conventional field sequential driving method, when the W image that is displayed by mixing the R, G, and B primary colors is moved on the screen, color breakup may occur due to the time difference generated since the R, G, and B images are displayed before and after the W image is moved. However, according to the current exemplary embodiment of the present invention, the W image is displayed in the additional W field, and thus, color breakup can be reduced or removed.

Figure 7:
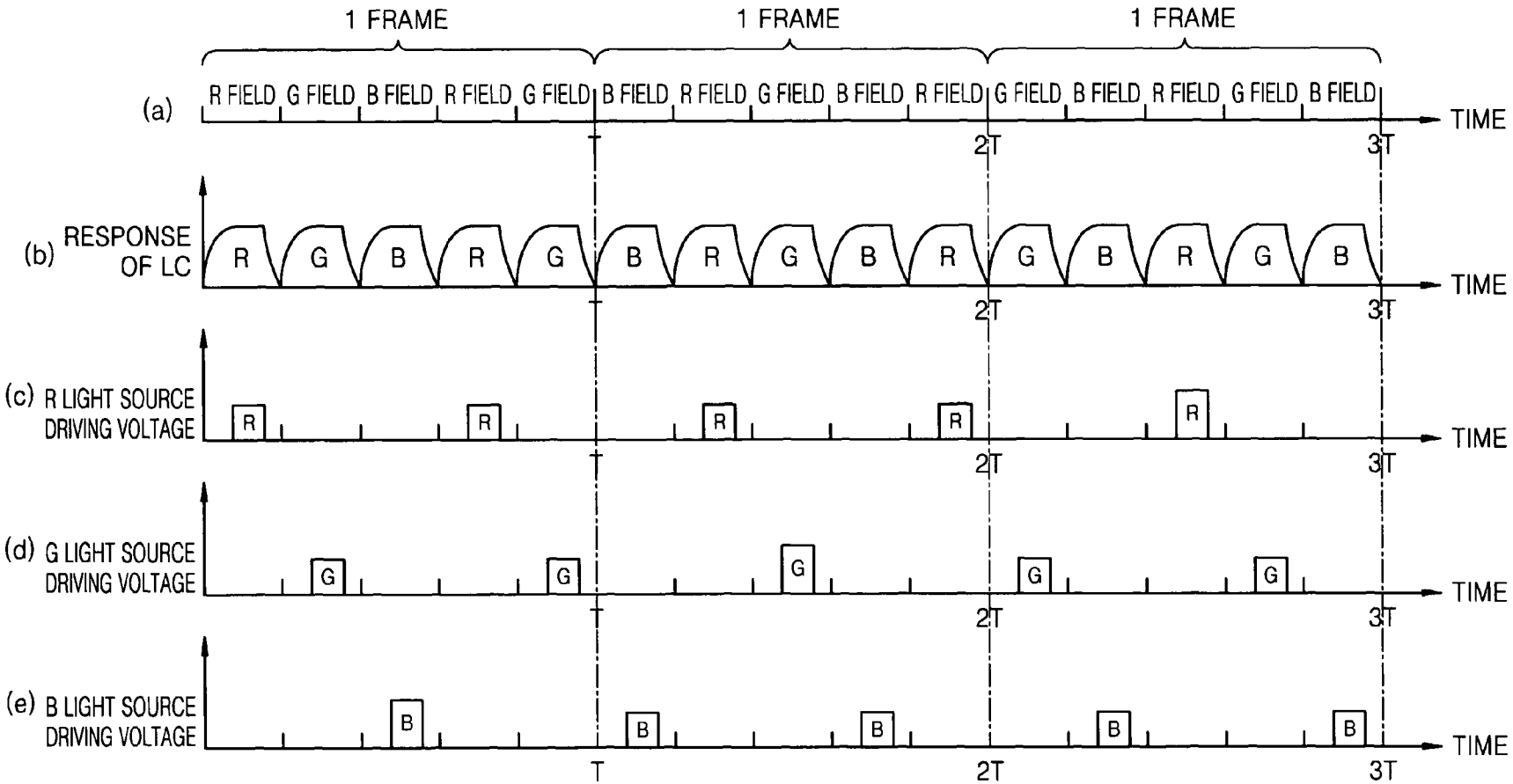

FIG. 7 is a view illustrating a method of driving the field sequential image display apparatus according to another exemplary embodiment of the present invention. According to the current exemplary embodiment of the present invention, one frame is divided into five fields only including R, G, and B fields.

Referring to FIG. 7, the image analyzing unit 10 divides three successive frames in an image signal into R, G, B, R, and G fields, B, R, G, B, and R fields, and G, B, R, G, and B fields, respectively. Referring to row (a) of FIG. 7, a first frame is displayed from 0 T to 1 T in an order of R, G, B, R and G fields, a second frame is displayed from 1 T to 2 T in an order of B, R, G, B, and R fields, and a third frame is displayed from 2 T to 3 T in an order of G, B, R, G, and B fields. The fields are displayed in such an order so as not to display fields of the same color successively on the image display panel. The same arrangement of the fields occurs in every three frames. When displaying the three frames, each of the R, G, and B fields is repeatedly displayed five times.

Row (b) of FIG. 7 represents the response of the liquid crystal according to time in the liquid crystal panel, and rows (c)-(e) represent driving voltages for driving the R, G, and B light sources. Although a primary color field is shown twice in a frame, fields of the same color are not arranged successively, and thus, a light source corresponding to fields of the same color does not emit light twice consecutively. In an image signal having a frame rate of 60 Hz, each of the R, G, and B light sources is driven five times in every three frames, and thus, each of the R, G, and B light sources is driven with a period of 10 ms on average. The time interval can be converted into a driving frequency of 100 Hz. Since the R, G, and B light sources are driven with such a high driving frequency, flicker can be greatly reduced.

Figure 8:
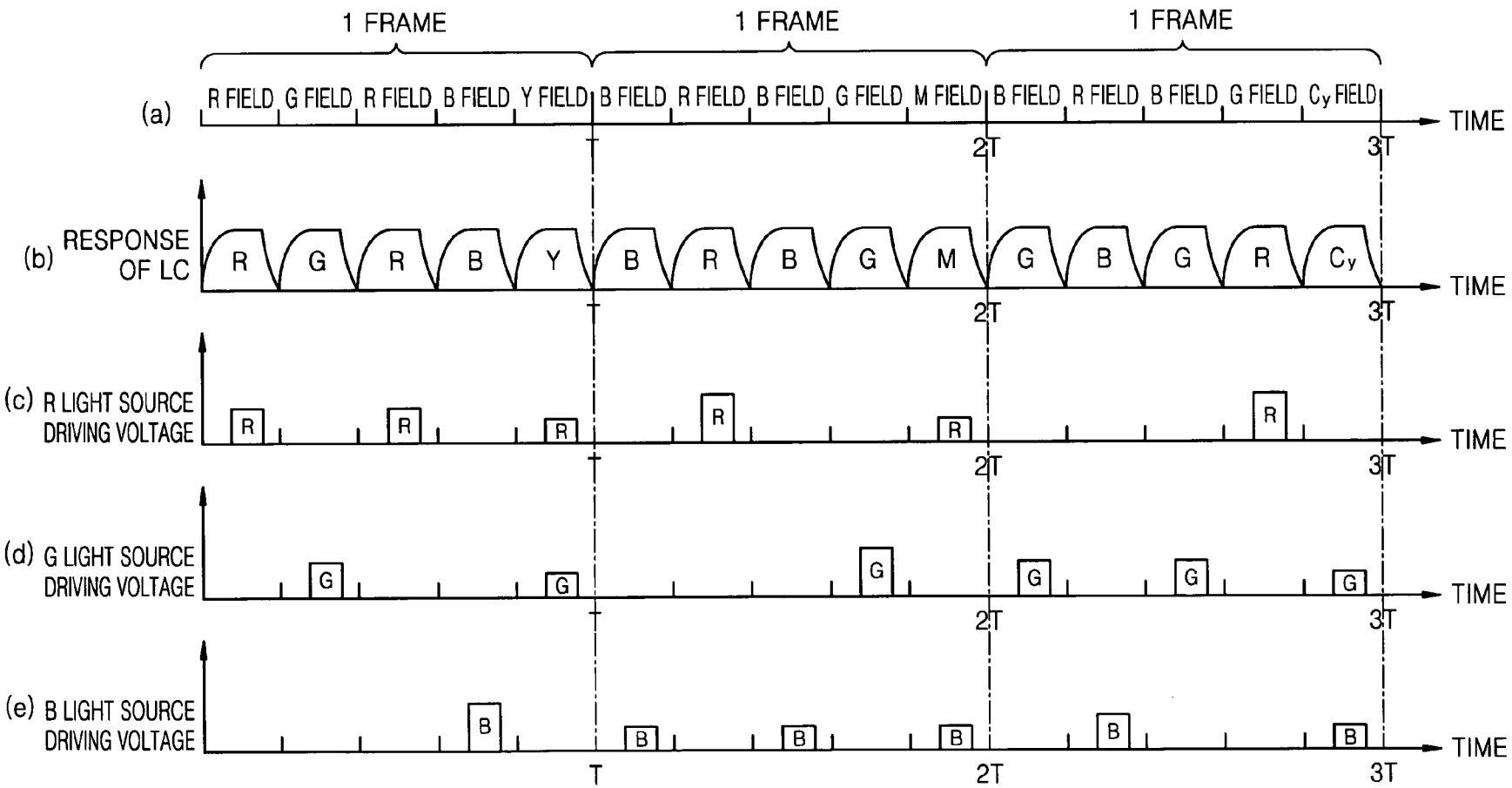

FIG. 8 is a view for illustrating a method of driving the field sequential image display apparatus according to another exemplary embodiment of the present invention. According to the current exemplary embodiment of the present invention, one frame is divided into five fields, and in particular, four of the five fields include R, G, and B fields, and the one remaining field is a Y, M, or Cy field.

Referring to FIG. 8, the image analyzing unit 10 divides three successive frames of an image signal into R, G, R, B, and Y fields, B, R, B, G, and M; fields, and R, G, B, B, and Cy fields, respectively.

Referring to row (a) of FIG. 8, a first frame is displayed from 0 T to 1 T in an order of R, G, R, B, and Y fields, a second frame is displayed from 1 T to 2 T in an order of B, R, B, G, and M fields, and a third frame is displayed from 2 T to 3 T in an order of G, B, G, R, and Cy fields. The fields are displayed in such an order so as not to display fields of the same color successively on the image display panel. The same arrangement of the fields occurs in every three frames. When displaying the three frames, each of the R, G, and B fields is repeatedly displayed four times, and each of the Y, M, and Cy fields is displayed once.

Row (b) of FIG. 8 represents the response of the liquid crystal according to time in the liquid crystal panel, and rows 8 (*c*)-(*e*) represent driving voltages for driving the R, G, and B light sources. Although a primary color field is shown three times in a frame, fields of the same color are not arranged successively, and thus, the R, G, and B light sources corresponding to the fields do not emit light consecutively. In an image signal having a frame rate of 60 Hz, each of the R, G, and B light sources is driven six times in every three frames, and thus, each of the R, G, and B light sources is driven with a period of 8.3 ms on average. The time interval can be converted into a driving frequency of 120 Hz. Since the R, G, and B light sources are driven with such a high driving frequency, flicker can be greatly reduced.

Figure 9:
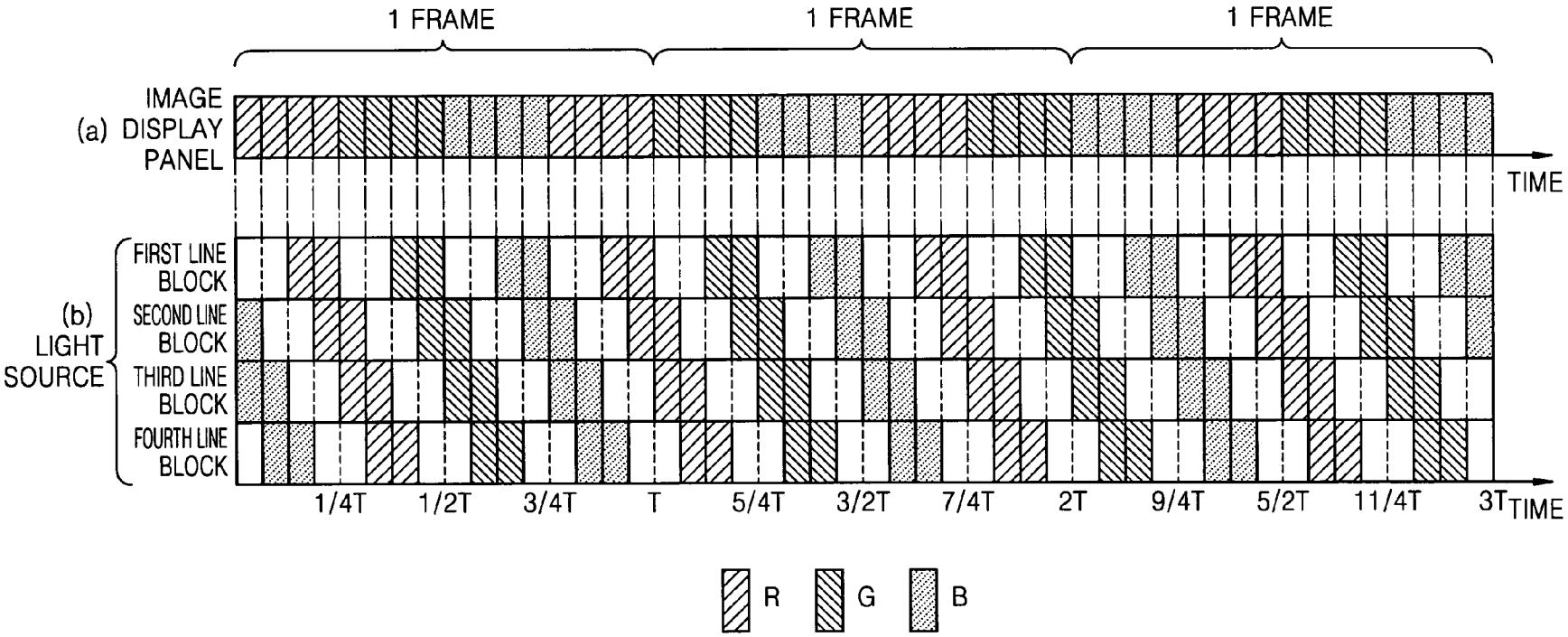

FIG. 9 is a view for illustrating a method of driving the field sequential image display apparatus according to another exemplary embodiment of the present invention. The arrangement order of the fields of the current exemplary embodiment is the same as that of the embodiment illustrated in FIG. 3, and thus, differences of the current embodiment from the embodiment of FIG. 3 will be described.

The R, G, and B light sources are driven using a scrolling method according to the current exemplary embodiment of the present invention. That is, unlike the embodiment of FIG. 3, the light source corresponding to the region, on which the response of liquid crystal is completed, is driven at the same time, and different color light sources can be driven on the other region.

Referring to row (b) of FIG. 9, three successive frames are displayed in orders of R, G, B, and R fields, G, B, R, and G fields, and B, R, G, and B fields, respectively. On the screen, a plurality of gate lines are classified as a first line block through a fourth line block in groups. In FIG. 9 the plurality of gate lines are divided into four line blocks, however, the present invention is not limited thereto.

Referring to row (b) of FIG. 9, a first frame is scanned from the R field, the first line block of the R field is scanned for 1/16 T from 0 T, and the arrangement of the liquid crystal on the first line block is completed at 1/8 T. In response to the scan of the first line block, the R light source on the region corresponding to the first line block is driven from 1/8 T to 1/4 T. The second line block of the R field is scanned for 1/8 T from 1/16 T, and the liquid crystal corresponding to the second line block of the R field are arranged at 3/16 T. In addition, in response to the scan of the second line block, the R light source on the region corresponding to the second line block is driven from 3/16 T to 5/16 T. As described above, the light source corresponding to the scanned line block is driven, and thus, the lighting time of the light source is increased and the contrast can be improved.

In the current exemplary embodiment of the present embodiment, the scrolling method is applied with respect to the field arrangement in the exemplary embodiment of FIG. 3, however, it also can be applied to the other exemplary embodiments shown in FIGS. 4 through 8.

In addition, in the above exemplary embodiments of the present invention, a liquid crystal panel is used as the image display panel, however, the present invention is not limited thereto. Exemplary embodiments of the present invention can also be applied to a light receiving type image display panel that requires an additional light source. That is, in a field sequential image display apparatus adopting the light receiving type image display panel, which cannot emit the light by itself and requires an additional light source, the average driving frequency of each of the light sources is increased without converting the frame rate, and thus, flicker generated due to the operation of light sources can be removed or reduced. The light receiving type image display panel may be a liquid crystal on silicon (LCoS) or a digital micro-mirror device (DMD).

As described above, in the field sequential image display apparatus and the method of driving the same according to exemplary embodiments of the present invention, the average driving frequency of the single color light sources can be increased without changing the frame rate, and thus, flicker can be reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A field sequential image display apparatus, which uses a plurality of single color light sources, the apparatus comprising:

an image analyzing unit dividing all frames of an image signal into fields, whereby the number of fields is greater than the number of colors of the plurality of single color light sources;

an image display panel displaying the fields sequentially; and a light source unit comprising the plurality of single color light sources that are one of independently driven and driven with other light sources in order to supply lights corresponding to color components of the fields to the image display panel, wherein each of the fields is scanned on the entire image display panel, wherein an average driving frequency of each of the plurality of single color light sources is higher than a frame rate, the image analyzing unit divides three successive frames, including a first frame, a second frame and a third frame, into the fields and assigns a color to each field of the three successive frames according to a first arrangement order, a second arrangement order and a third arrangement order, respectively, such that the first arrangement order, the second arrangement order and the third arrangement order are different from each other, and the fields among all of the frames are displayed such that a single color light source of the plurality of single color light sources is never driven successively.

2. The apparatus of claim 1, wherein the plurality of single color light sources are R, G, and B light sources, and each of the frames of the image signal is divided into four fields comprising R, G, and B fields among R, G, B, Cy, M, and Y fields respectively displaying R, G, B, Cy, M, and Y images.

3. The apparatus of claim 2, wherein the G and B light sources are driven in synchronization with the Cy field, the B and R light sources are driven in synchronization with the M field, and the R and G light sources are driven in synchronization with the Y field.

4. The apparatus of claim 2, wherein the three successive frames include field groups comprising R, G, B, and R fields, R, G, B, and G fields, and R, G, B, and B fields, respectively.

5. The apparatus of claim 2, wherein the three successive frames include field groups comprising R, G, B, and Cy fields, R, G, B, and M fields, and R, G, B, and Y fields, respectively.

6. The apparatus of claim 1, wherein the single color light sources are R, G, and B light sources, and each of the frames of the image signal is divided into at least five fields comprising R, G, and B fields among R, G, B, Cy, M, Y, and W fields respectively displaying R, G, B, Cy, M, Y, and W images.

7. The apparatus of claim 6, wherein the G and B light sources are driven in synchronization with the Cy field, the B and R light sources are driven in synchronization with the M field, the R and G light sources are driven in synchronization with the Y field, and the R, G, and B light sources are driven in synchronization with the W field.

8. The apparatus of claim 6, wherein the three successive frames include field groups comprising R, G, B, R, and W fields, R, G, B, G, and W fields, and R, G, B, B, and W fields, respectively.

9. The apparatus of claim 6, wherein the three successive frames include field groups comprising R, G, B, R, and G fields, R, G, B, G, and B fields, and R, G, B, B, and R fields, respectively.

10. The apparatus of claim 6, wherein the three successive frames include field groups comprising R, G, B, R, and Cy fields, R, B, G, G, and M fields, and R, B, G, B, and Y fields, respectively.

11. The apparatus of claim 1, wherein the single color light sources are sequentially driven whenever one or more gate lines in the fields are scanned.

12. The apparatus of claim 1, wherein the frame rate is 60 Hz, and the average driving frequency of the plurality of single color light sources is higher than 60 Hz.

13. The apparatus of claim 1, wherein the image display panel is one of a liquid crystal panel, a liquid crystal on silicon (LCoS), and a digital micro-mirror device.

14. The apparatus of claim 1, wherein primary color fields of R, G and B fields of the first frame, the second frame and the third frame, are arranged in different arrangements in relation to corresponding fields of the three successive frames.

15. The apparatus of claim 1, wherein the first arrangement order, the second arrangement order and the third arrangement are repeated in turn for a next three successive frames, where the third frame is adjacent to a first frame of the next three successive frames.

16. The apparatus of claim 1, wherein the fields among all of the frames are displayed such that two successive fields do not display a same color.

17. A method of driving a field sequential image display apparatus using a plurality of single color light sources, the method comprising:

dividing all frames of an image signal into fields, whereby the number of fields is greater than the number of the plurality of single color light sources;

sequentially displaying the fields on an image display panel; and driving one or more of the plurality of single color light sources in synchronization with one of the displayed fields in order to supply light corresponding to a color component of a displayed field to the image display panel, wherein each of the fields is scanned on the entire image display panel, wherein an average driving frequency of each of the plurality of single color light sources is greater than a frame rate, the three successive frames, including a first frame, a second frame and a third frame, are divided into the fields and a color is assigned to each field of the three successive frames according to a first arrangement order, a second arrangement order and a third arrangement order, respectively, such that the first arrangement order, the second arrangement order and the third arrangement order are different from each other, and the fields among all of the frames are displayed such that a single color light source of the plurality of single color light sources is never driven successively.

18. The method of claim 17, wherein the plurality of single color light sources are red (R), green (G), and blue (B) light sources, and each of the frames of the image signal is divided into four fields comprising R, G, and B fields among R, G, B, cyan (Cy), magenta (M), and yellow (Y) fields respectively displaying R, G, B, Cy, M, and Y images.

19. The method of claim 18, wherein the driving of the plurality of single color light sources comprises:

driving the G and B light sources to correspond to the Cy field, driving the B and R light sources to correspond to the M field, and driving the R and G light sources to correspond to the Y field.

20. The method of claim 18, wherein the dividing of the frames of the image signal comprises:

dividing the three successive frames into field groups comprising R, G, B, and R fields, R, G, B, and G fields, and R, G, B, and B fields, respectively.

21. The method of claim 18, wherein the dividing of the frames of the image signal comprises:

dividing the three successive frames into field groups comprising R, G, B, and Cy fields, R, G, B, and M fields, and R, G, B, and Y fields, respectively.

22. The method of claim 17, wherein the plurality of single color light sources are R, G, and B light sources, and each of the frames of the image signal is divided into at least five fields comprising R, G, and B fields among R, G, B, Cy, M, Y, and white (W) fields respectively displaying R, G, B, Cy, M, Y, and W images.

23. The method of claim 22, wherein the driving of the one or more of the plurality of single color light sources comprises:

driving the G and B light sources to correspond to the Cy field, driving the B and R light sources to correspond to the M field, driving the R and G light sources to correspond to the Y field, and driving the R, G, and B light sources to correspond to the W field.

24. The method of claim 22, wherein the dividing of the frames of the image signal comprises:

dividing the three successive frames into field groups comprising R, G, B, R, and W fields, R, G, B, G, and W fields, and R, G, B, B, and W fields, respectively.

25. The method of claim 22, wherein the dividing of the frames of the image signal comprises:

dividing the three successive frames into field groups comprising R, G, B, R, and G fields, R, G, B, G, and B fields, and R, G, B, B, and R fields, respectively.

26. The method of claim 22, wherein the dividing of the frames of the image signal comprises:

dividing the three successive frames into field groups comprising R, G, B, R, and Cy fields, R, B, G, G, and M fields, and R, B, G, B, and Y fields, respectively.

27. The method of claim 17, wherein the displaying of the fields is performed so that two successive fields do not display a same color.

28. The method of claim 17, wherein the driving of the one or more of the plurality of single color light sources is performed sequentially whenever one or more gate lines in the fields are scanned.

29. The method of claim 17, wherein the frame rate is 60 Hz, and the average driving frequency of the plurality of single color light sources is higher than 60 Hz.

30. The method of claim 17, wherein the driving of the one or more of the plurality of single color light sources is controlled by one of a driving voltage and a light emitting time of each of the one or more of the plurality of single color light sources so that lights emitted from the one or more of the plurality of the single color light sources driven in one frame have constant brightness.

31. The method of claim 17, wherein primary color fields of R, G and B fields of the first frame, the second frame and the third frame, are arranged in different arrangements in relation to corresponding fields of the three successive frames.

32. The method of claim 17, wherein the first arrangement order, the second arrangement order and the third arrangement are repeated in turn for a next three successive frames, where the third frame is adjacent to a first frame of the next three successive frames.

* * * * *